US008690025B2

(12) United States Patent
Kojima et al.

(10) Patent No.: US 8,690,025 B2
(45) Date of Patent: Apr. 8, 2014

(54) DISPENSING CONTAINER

(75) Inventors: Shinichi Kojima, Tokyo (JP); Masayuki Takahashi, Tokyo (JP)

(73) Assignee: GC Corporation, Bunkyo-ku (JP)

( * ) Notice: Subject to any disclaimer, the term of this patent is extended or adjusted under 35 U.S.C. 154(b) by 60 days.

(21) Appl. No.: 13/199,219

(22) Filed: Aug. 22, 2011

(65) Prior Publication Data

US 2012/0043350 A1 Feb. 23, 2012

(30) Foreign Application Priority Data

Aug. 21, 2010 (JP) ..... 2010-185668
Jun. 25, 2011 (JP) ..... 2011-141274

(51) Int. Cl.
*B65D 47/18* (2006.01)

(52) U.S. Cl.
USPC ..... 222/420; 222/213; 222/105; 222/183; 604/212; 604/295; 604/310

(58) Field of Classification Search
USPC ..... 222/420, 105, 183, 95, 214, 215, 213; 401/126, 183, 184; 138/124; 604/212, 604/295, 310
See application file for complete search history.

(56) References Cited

U.S. PATENT DOCUMENTS 1,935,639 A * 11/1933 Keeshan ..... 401/192
2,358,159 A * 9/1944 Gruetter ..... 604/310
2,590,353 A * 3/1952 Schaar et al. ..... 137/625.28
2,600,978 A * 6/1952 Demarco, Jr. ..... 215/11.1
2,802,605 A * 8/1957 Parker ..... 222/215
4,811,866 A * 3/1989 Golias ..... 222/189.06
4,917,274 A * 4/1990 Asa et al. ..... 222/420
5,220,741 A * 6/1993 Burgeson ..... 43/1
5,799,837 A * 9/1998 Firestone et al. ..... 222/215

(Continued)

FOREIGN PATENT DOCUMENTS

DE 102009039624 A1 3/2010
JP H10-175683 6/1998

(Continued)

OTHER PUBLICATIONS

European Search Report in EP Application No. 11006834.3, issue date Jan. 13, 2012.

*Primary Examiner* — Paul R Durand
*Assistant Examiner* — Charles P Cheyney
(74) *Attorney, Agent, or Firm* — Masuvalley & Partners

(57) ABSTRACT

A dispensing container according to the invention includes a container body having a rod-like shape. The dispensing container is therefore compact and the user can hold the dispensing container as if the user holds a pen and use the thumb, the index finger, and any other finger to apply pressure to the dispensing container so as to dispense a drug solution. A heat insulating grip is attached to the outer circumferential surface of the container body, whereby heat originating from the body temperature of a finger of the user will not be transferred to the drug solution or volatilize it. No excessive dispensing that is not intended by the user will therefore occur. Since the container body is thin and hence unlikely crashed, the user can make adjustment of the pressure applied by the thumb, the index finger, and any other finger to readily extract a single droplet.

9 Claims, 10 Drawing Sheets

(56) References Cited

U.S. PATENT DOCUMENTS

| | | | | |
|---|---|---|---|---|
| 5,971,208 | A * | 10/1999 | Kennedy | 222/54 |
| 6,041,952 | A | 3/2000 | Martin | |
| 6,258,063 | B1 * | 7/2001 | Haar et al. | 604/141 |
| 6,612,469 | B2 * | 9/2003 | Lopez Pardo | 222/214 |
| 6,709,180 | B2 * | 3/2004 | Cochran | 401/1 |
| 2006/0054635 | A1 * | 3/2006 | Iwahashi et al. | 222/107 |
| 2008/0308647 | A1 * | 12/2008 | Maget et al. | 239/34 |
| 2010/0075276 | A1 | 3/2010 | Nakatsuka et al. | |

FOREIGN PATENT DOCUMENTS

| | | |
|---|---|---|
| JP | 2000-85860 | 3/2000 |
| JP | 2009-207593 | 9/2009 |
| WO | WO 2009/053851 | 4/2009 |

* cited by examiner

DISPENSING CONTAINER

This application claims priority under 35 U.S.C. §119 from Japanese patent application Serial No. 2010-185668, filed Aug. 21, 2010, and Japanese patent application Serial No. 2011-141274, filed Jun. 25, 2011, which are incorporated herein by reference in their entirety.

TECHNICAL FIELD

The present invention relates to a dispensing container for encapsulating and dispensing a drug solution.

BACKGROUND ART

Among dispensing containers that encapsulate a small amount of drug solution, those particularly for dispensing a small amount of drug solution (about a single droplet) per operation are often so used that the drug solution is extracted from the dispensing container into a dish or the drug solution is directly applied to an affected site or administered. When the drug solution is a dental liquid material containing a low boiling point component, heat originating from the body temperature of a finger is transferred to the drug solution (through conduction or radiation) and volatilizes the drug solution, resulting in an increase in internal pressure in the container, which is problematic because more than a user's intended amount of drug solution, for example, two or more droplets are extracted and dispensed. The problem often occurs when a drug solution required to be refrigerated is taken out of a refrigerator. A dispensing container of related art has a thin heat insulating label (about 0.3 mm in thickness) attached to the side surface of a bottle-shaped container body. Since the label, however, does not have enough heat insulation capability or the bottom of the container body is not heat insulated, the problem described above is not eliminated.

To address the problem, for example, Patent Document 1 discloses a dispensing container with a thick heat insulating cover that covers the side and bottom surfaces of a bottle-shaped container body. The heat insulating cover has a plurality of ribs formed over the inner surface thereof. According to the thus configured dispensing container, since the container body is insulated by the insulating cover and the gaps between the ribs, the problem described above, two or more droplets of drug solution are extracted and dispensed, can be solved. Patent Document 2 discloses a dispensing container including a bottle container that accommodates a bottle-shaped container body. According to the thus configured dispensing container, since the container body is insulated by the bottle container, the problem described above, two or more droplets of drug solution are extracted and dispensed, can be solved.

Patent Document 3 discloses a dispensing container including a bottle-shaped container body whose side surface is covered with a jacket with a gap therebetween. According to the thus configured dispensing container, since the container body is insulated by the jacket and the gap, the problem described above, two or more droplets of drug solution are extracted and dispensed, can be solved. Patent Document 4 discloses a dispensing container including a mechanism that forces a fluid to be discharged. According to the thus configured dispensing container, the forcible discharge mechanism always allows a single droplet of drug solution to be extracted and dispensed.

TECHNICAL DOCUMENTS OF RELATED ART

Patent Documents

[Patent Document 1] Japanese Patent No. 3,572,158
[Patent Document 2] Japanese Patent Laid-Open No. 2000-85860
[Patent Document 3] Japanese Patent Laid-Open No. 2009-207593
[Patent Document 4] WO 2009/053851 A2

SUMMARY OF THE INVENTION

Problem to be Solved by the Invention

In the dispensing container described in Patent Document 1, the heat insulating cover may provide expected heat insulation, but attaching the heat insulating cover reduces visibility of information displayed on the side surface of the container body. Further, attaching the heat insulating cover increases the overall size (diameter) of the container, resulting in degradation in exterior appearance. In the dispensing container described in Patent Document 2, the bottle container may also provide expected heat insulation, but using the bottle container reduces visibility of information displayed on the side surface of the container body. Further, using the bottle container increases the overall size (diameter) of the container, resulting in degradation in exterior appearance. Moreover, when two container bodies are accommodated side by side in the bottle container, opening and closing a cap and other usability are compromised. In the dispensing container described in Patent Document 3, since the bottom surface of the container body is not insulated, the problem described above, two or more droplets of drug solution are dispensed, is still present in some cases. In the dispensing container described in Patent Document 4, since the container body is formed of a large number of parts, it is difficult to ensure a sufficient amount of content and material cost increases.

An object of the invention is to provide a dispensing container that has a compact container body, can readily extract and dispense a single droplet of drug solution, and provides excellent visibility of information displayed on the side surface of the container body.

Means for Solving the Problem

To achieve the object of the invention, the invention provides a dispensing container for dispensing a drug solution, the dispensing container comprising a rod-shaped container body formed of a smaller-diameter portion having a discharge port that is an open end and a larger-diameter portion having a block end, a nozzle that extends from the discharge port outward in an axial direction of the container body, and a grip made of a heat insulating material and covering an outer circumferential surface of the smaller-diameter portion of the container body. An edge of the grip is in contact with a stepped portion where the smaller-diameter portion and the larger-diameter portion are connected to each other.

In the dispensing container having the features described above, since the container body has a rod-like shape, the dispensing container is compact and the user can hold the dispensing container as if the user holds a pen and use the thumb, the index finger, and any other finger to apply pressure to the dispensing container so as to dispense a drug solution. Since the heat insulating grip is attached to the outer circumferential surface of the container body, heat originating from the body temperature of a finger of the user will not be transferred to the drug solution (through conduction or radiation) or volatilize it. Excessive dispensing that is not intended by the user will therefore not occur. Since the container body is thin and hence unlikely crashed, the user can make adjustment of the pressure applied by the thumb, the index finger, and any other finger to readily extract a single droplet.

Further, since an edge of the grip is in contact with the stepped portion formed where the smaller-diameter portion and the larger-diameter portion are connected to each other, the grip will not disengage from the container body and it is easy to see the grip. Information, when displayed on the side surface on one side of the container body, is readily recognized. Moreover, the grip is made of an elastomer and the surface thereof has undergone a non-slip treatment to provide a non-slip property. As a result, the user can make fine adjustment of the pressure applied by the thumb, the index finger, and any other finger to reliably extract a single droplet.

Advantages of the Invention

The invention provides a dispensing container that has a compact container body, can readily extract and dispense a single droplet of drug solution, and provides excellent visibility of information displayed on the side surface of the container body.

MODES FOR CARRYING OUT THE INVENTION

Embodiments of the invention will be described with reference to the drawings. It is noted that the embodiments described below do not limit the scope of the invention set forth in the claims, and that all combinations of the features described in the embodiments are not necessarily essential to achieve the object of the invention.

Figure 1:
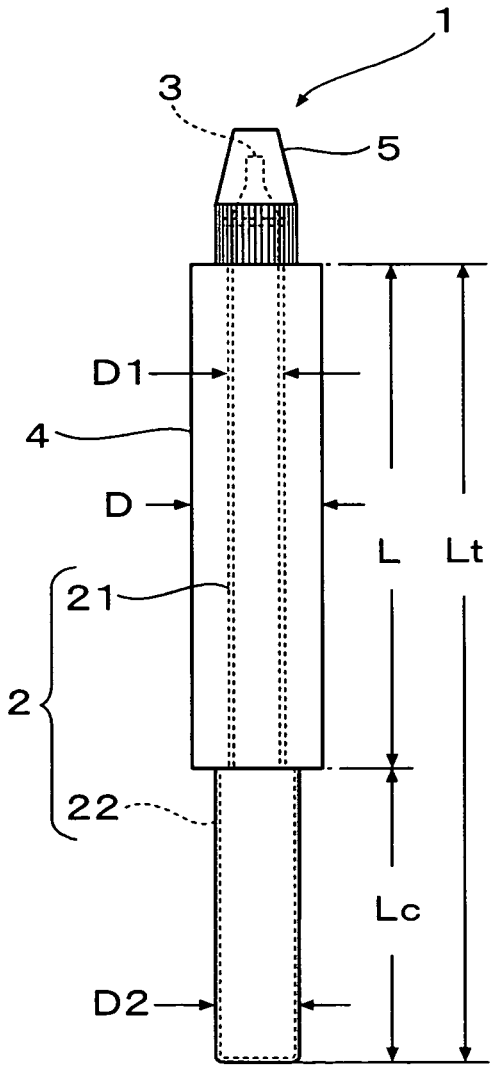
FIG. 1 is a plan view showing a first embodiment of a dispensing container according to the invention.
Figure 2:
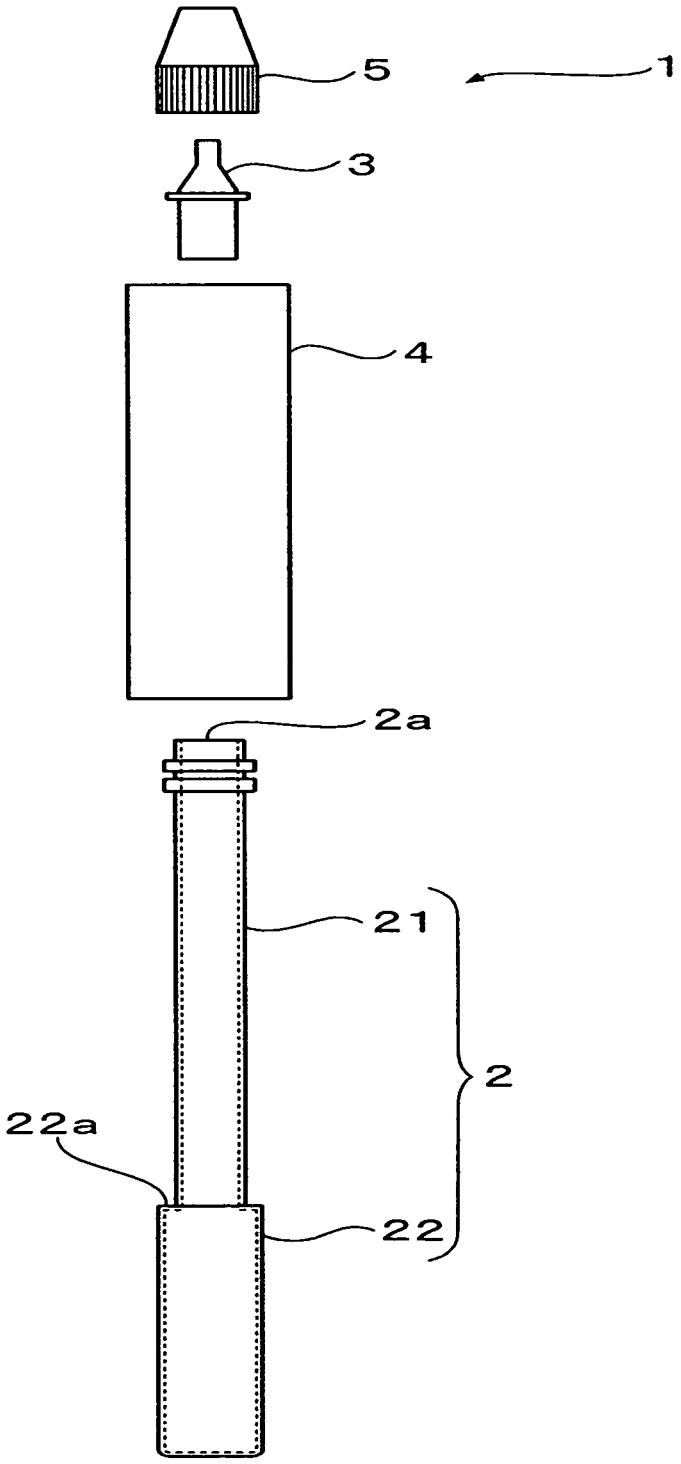
FIG. 2 is an exploded view of the dispensing container shown in FIG. 1.

A dispensing container 1 according to a first embodiment of the invention includes a container body 2, a nozzle 3, a grip 4, and a cap 5, as shown in FIGS. 1 and 2.

The container body 2 has an elongated rod-like shape with one side blocked and the other side open as a discharge port 2*a*. The container body 2 is so formed that the one side thereof is greater than the other side in terms of diameter, that is, the diameter D2 on the one side is greater than the diameter D1 on the other side. A step surface 22*a* is formed at a portion where a smaller-diameter portion 21 and a larger-diameter portion 22 of the container body 2 are connected to each other.

The nozzle 3 has a substantially triangular pyramidal shape extending from the discharge port 2*a* of the container body 2 outward in the axial direction of the container body 2.

The grip 4 is attached to the smaller-diameter portion 21 on the other side of the container body 2.

The cap 5 is so attached to the container body 2 that the cap 5 covers the nozzle 3 when the dispensing container 1 is not in use.

Figure 3:
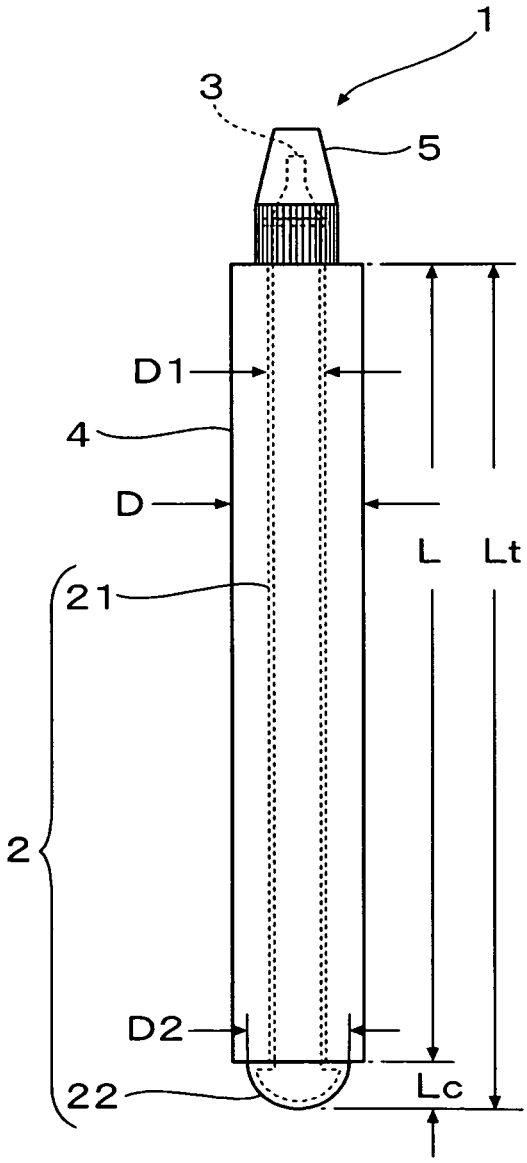
FIG. 3 is a plan view showing a second embodiment of the dispensing container according to the invention.
Figure 4:
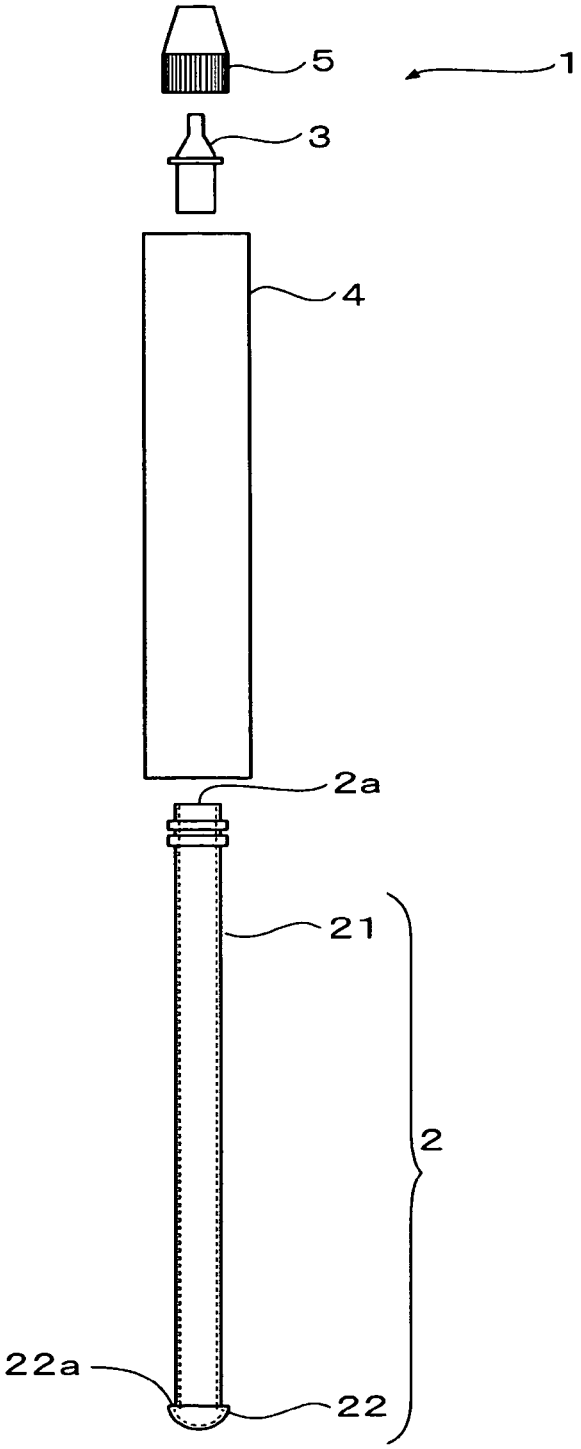
FIG. 4 is an exploded view of the dispensing container shown in FIG. 3.

A dispensing container 1 according to a second embodiment of the invention includes a container body 2, a nozzle 3, a grip 4, and a cap 5, as shown in FIGS. 3 and 4.

The container body 2 is formed of a smaller-diameter portion 21 having an elongated rod-like shape and provided with a discharge port 2*a* and a larger-diameter portion 22 having a closed bottom. A step surface 22*a* is formed at a portion where the smaller-diameter portion 21 and the larger-diameter portion 22 of the container body 2 are connected to each other.

The nozzle 3 has a substantially triangular pyramidal shape extending from the discharge port 2*a* of the container body 2 outward in the axial direction of the container body 2.

The grip 4 is attached to the smaller-diameter portion 21 on the other side of the container body 2.

The cap 5 is so attached to the container body 2 that the cap 5 covers the nozzle 3 when the dispensing container 1 is not in use.

The dispensing container according to the invention, including the dispensing containers according to the first and second embodiments, will be described below.

Figure 5:
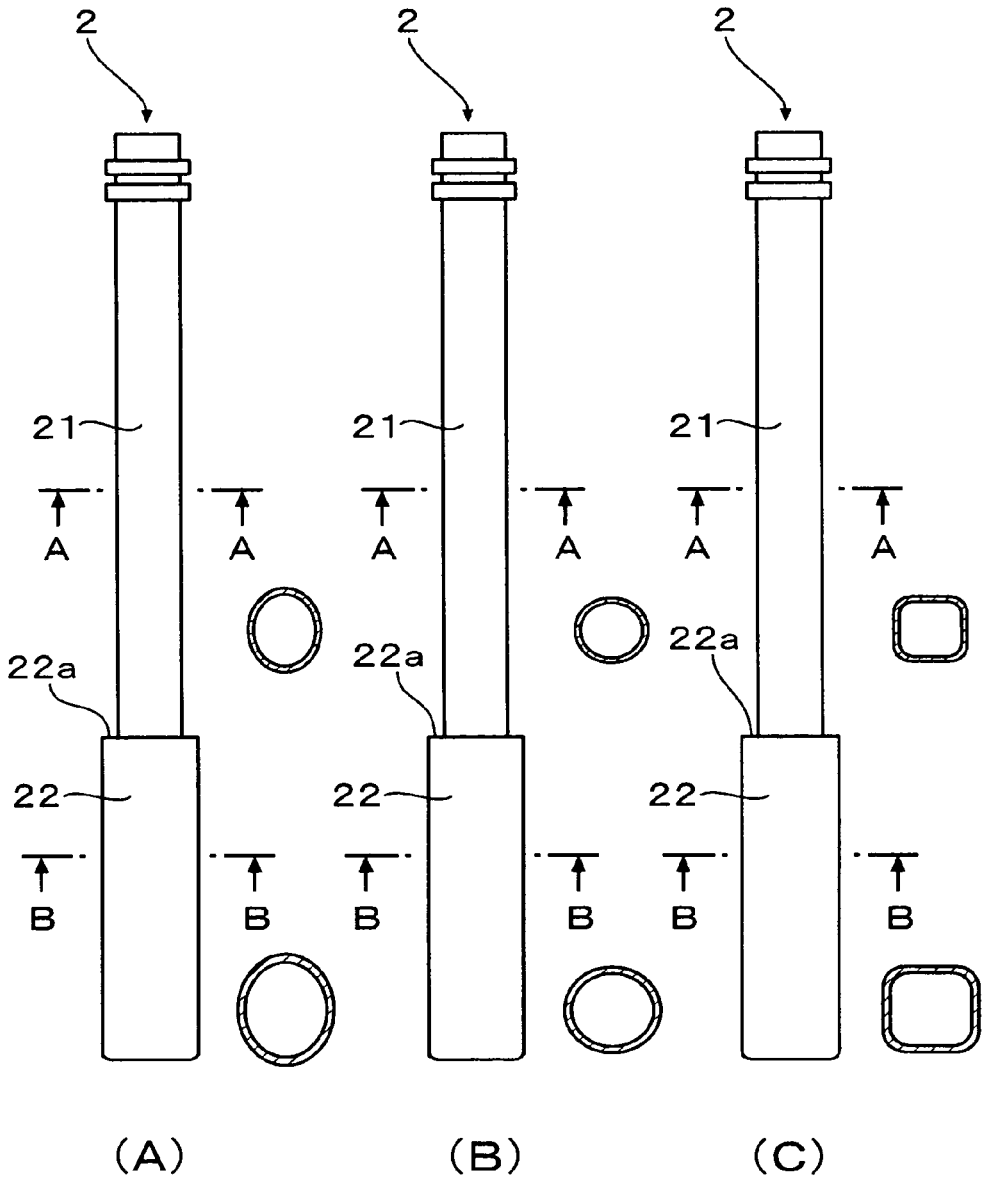
FIGS. 5A to 5C show examples of the cross-sectional shape of a container body of the dispensing container shown in FIG. 1.
Figure 6:
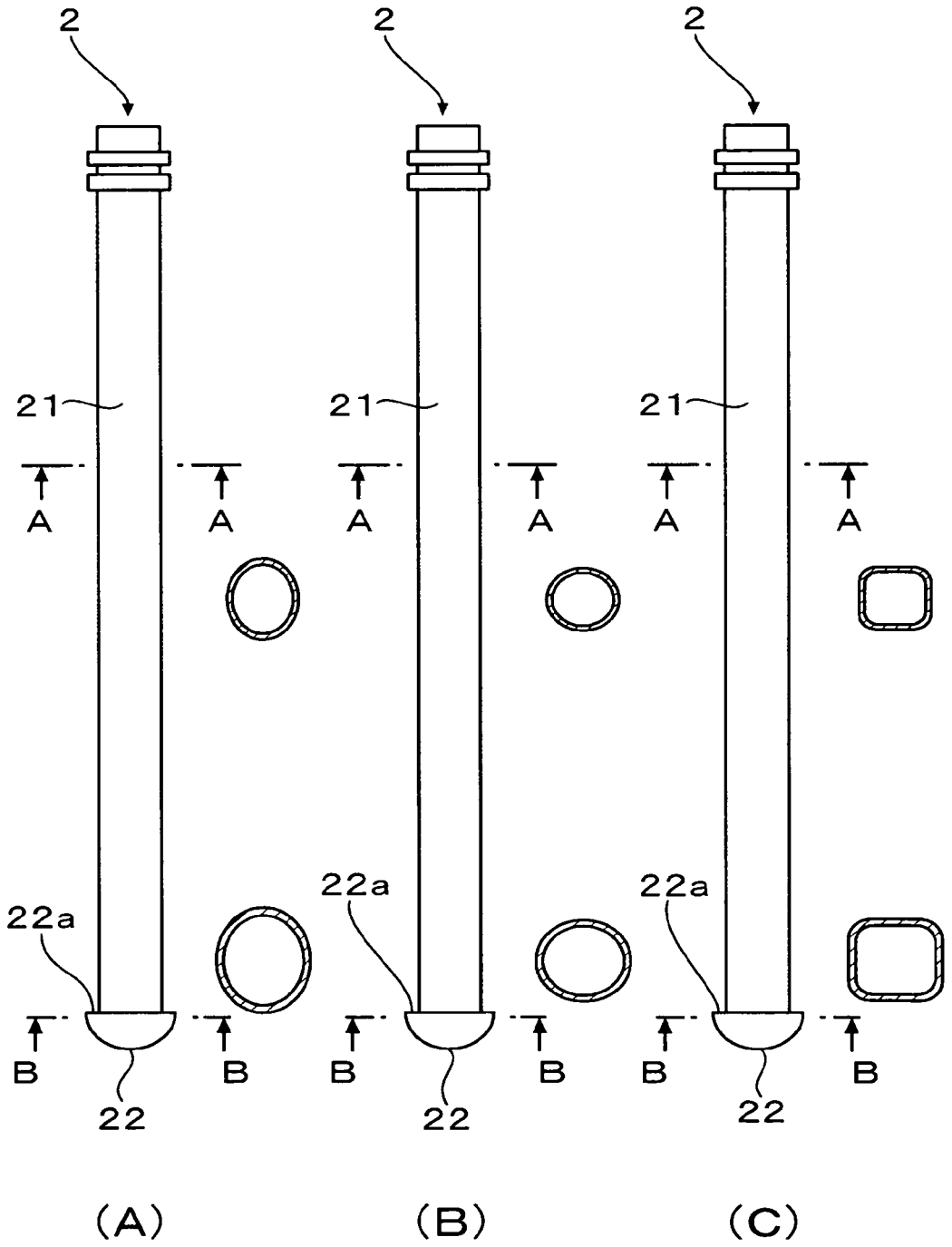
FIGS. 6A to 6C show examples of the cross-sectional shape of a container body of the dispensing container shown in FIG. 3.

The cross-sectional shape of the smaller-diameter portion 21 of the container body 2 taken along a plane perpendicular to the central axis of the container body 2 is selected in consideration of functionality as a wrapping member, such as ease of grip, productivity, and exterior appearance and may have any suitable shape, such as an ellipse shown in FIGS. 5(A) and 6(A) (major and minor diameters of smaller-diameter portion 21 range from 8 to 13 mm and major diameter is greater than minor diameter), a circle shown in FIGS. 5(B) and 6(B) (diameter of smaller-diameter portion 21 ranges from 8 to 13 mm), a rectangle shown in FIGS. 5(C) and 6(C) (length of one side and length of diagonal of smaller-diameter portion 21 range from 8 to 13 mm) and any other polygonal shape.

The diameter D1 of the smaller-diameter portion 21 or the longest and shortest portions of the cross-sectional shape of the smaller-diameter portion 21, including the ellipse, the circle, and the rectangle described above, preferably range from 8 to 13 mm. When the diameter D1 of the smaller-diameter portion 21 of the container body 2 falls within the range described above, the grip 4 has not only a wall thickness thick enough to dispense a single droplet but also a sufficient diameter that allows the user to readily hold the grip 4 as if the user grips a pen.

The wall thickness of the smaller-diameter portion 21 of the container body 2 preferably ranges from 0.3 to 0.9 mm. When the diameter D1 and the wall thickness of the smaller-diameter portion 21 of the container body 2 fall within the ranges described above, and the user applies pressure to the smaller-diameter portion 21 via the grip 4 with the thumb, the index finger, and any other finger, the smaller-diameter portion 21 will not deform greatly but deform moderately, whereby a single droplet can be dispensed.

The cross-sectional shape of the larger-diameter portion 22 taken along a plane passing through the central axis of the container body 2 may be a rectangle as shown in FIG. 1 or a semicircle as shown in FIG. 3. The cross-sectional shape of the larger-diameter portion 22 is not limited to the shapes described above but may be a semiellipse, a triangle or any other polygonal shape, a curved shape, or any other variety of shapes.

The length Lc of the larger-diameter portion 22 preferably ranges from 5 to 50 mm, more preferably from 5 to 10 mm.

The cross-sectional shape of the larger-diameter portion 22 of the container body 2 taken along a plane perpendicular to the central axis of the container body 2 may be any shape, such as the ellipse shown in FIGS. 5(A) and 6(A), the circle shown in FIGS. 5(B) and 6(B), and the rectangle shown in FIGS. 5(C) and 6(C) or any other polygonal shape.

The diameter D2 of the larger-diameter portion 22 or the longest and shortest portions of the cross-sectional shape of the larger-diameter portion 22, including the ellipse, the circle, and the rectangle described above, preferably range from 9 to 18 mm. Among cross sections of the larger-diameter portion 22 taken along planes perpendicular to the central axis of the container body 2, the diameter of a single cross section or a range of cross sections having the largest cross sectional area is defined as the diameter D2 of the larger-diameter portion 22.

When the length Lc and the diameter D2 of the larger-diameter portion 22 fall within the ranges described above, a sufficient volume of drug solution can be accommodated in the container body 2. When the larger-diameter portion 22 is made of a transparent or semi-transparent material, the remaining amount of drug solution can be readily visually checked.

Providing the larger-diameter portion 22 on one side of the container body 2 allows a sufficient amount of drug solution to be accommodated, and when the larger-diameter portion 22 is made of a transparent or semi-transparent material, the remaining amount of drug solution can be visually checked. Since the larger-diameter portion 22 is made of a transparent or semi-transparent material, the surface of the solution can be checked when a sufficient amount of drug solution is accommodated and even when the larger-diameter portion 22 is up. When the remaining amount of drug solution decreases and hence it is difficult to see the surface of the solution, the user can check the surface of the solution in the larger-diameter portion 22 by holding the dispensing container 1 horizontal, whereby the user can check how much the drug solution remains. When the amount of drug solution further decreases, the drug solution accommodated in the container body gathers in the larger-diameter portion 22 when the user inclines the dispensing container 1 or turns it upside down so that the larger-diameter portion 22 is down. The user then looks at the larger-diameter portion 22 to check the remaining amount of drug solution. When the grip 4 is made of a transparent or semi-transparent material, the amount of drug solution accommodated in the container body can be checked.

Further, information on the drug solution and other information are external shape of the step surface 22*a* may be so formed that it corresponds to the cross-sectional shape of the smaller-diameter portion 21. For example, when the cross-sectional shape of the smaller-diameter portion 21 is a circle, an ellipse, or a rectangle, the external shape of the step surface 22*a* may be a circle, an ellipse, or a rectangle. Further, the external shape of the step surface 22*a* does not necessarily correspond to the cross-sectional shape of the smaller-diameter portion 21. For example, when the cross-sectional shape of the smaller-diameter portion 21 is a circle, the external shape of the step surface 22*a* may be an ellipse or a rectangle. When the cross-sectional shape of the smaller-diameter portion 21 or the external shape of the step surface 22*a* is not a circle, the dispensing container 1 advantageously unlikely rolls on a flat surface.

When the external shape of the step surface 22*a* and the cross-sectional shape of the smaller-diameter portion 21 are both circles, the readily displayed on the larger-diameter portion 22 by printing or attaching a label. Information displayed on the container of a drug solution (medical tool) includes the name and address of the product manufacturer/distributor, the product name, the amount of content, a manufacturing code, the expiration date, storage conditions, and a large number of other pieces of information and requires an appropriately wide display space over the container. The information is readily recognized when displayed over the larger-diameter portion 22 of the container body 2. In particular, the elliptical shape shown in FIG. 5(A) is preferred because a wide display space is readily provided and hence the user can readily recognize the displayed information.

The external shape of the step surface 22*a* may be any shape, such as an ellipse, a circle, and a rectangle or any other polygonal shape, as in the case of the cross-sectional shape of the smaller-diameter portion 21. The step surface 22*a* has a ring shape along the outer circumference of the smaller-diameter portion 21 of the container body 2. When the external shape of the step surface 22*a* is a rectangle and the cross-sectional shape of the smaller-diameter portion 21 is a circle, the step surface 22*a* may have four portions at the four corners of the rectangle. The step surface 22*a* may have an arbitrary shape that functions as a stopper that prevents the grip 4 from moving toward the larger-diameter portion 22.

Conditions under which the step surface 22*a* is formed will be described below. Consider cross sections of the larger-diameter portion 22 taken along planes perpendicular to the central axis of the container body 2. Now, the diameter of the cross section closest to the smaller-diameter portion 21 is defined as a diameter D3 of the larger-diameter portion 22. The step surface 22*a* is formed when the diameter D3 of the larger-diameter portion 22 is greater than the diameter D1 of the smaller-diameter portion 21 in at least part of the circumferential region where the step surface 22*a* is formed. That is, the step surface 22*a* is formed in a circumferential region where D3>D1 is satisfied. When the grip 4 is fitted on the smaller-diameter portion 21 of the container body 2, the step surface 22*a* functions as a stopper that prevents the grip 4 from moving toward the larger-diameter portion 22.

The container body 2 having the "constricted shape" can be formed by direct blow forming or injection blow forming, both of which excel in cost per performance. The material of the container body 2 is not limited to a specific one but may be a multilayer plastic material including a gas barrier layer made, for example, of polyolefin or EVOH.

The nozzle 3 may have any shape that allows the user to readily view a droplet.

In the examples shown in FIGS. 1 and 3, since the diameter D of the grip 4 is so set that one side of the container body 2 has a diameter larger than or equal to the diameter D2 of the larger-diameter portion 22 (D≤D2) to prompt the user to grasp the grip 4. Including the examples shown in FIGS. 1 and 3, the diameter D of the grip 4 of the dispensing container according to the invention is set to be larger than or equal to the diameter D3 of the larger-diameter portion 22 (D≤D3) so as to provide a shape that prompts the user to hold the grip 4.

The grip 4 is preferably formed to have a wall thickness of at least 2 mm in order to provide satisfactory heat insulation and intended dispensing (single droplet dispensing).

The length L of the grip 4 is preferably at least 50 mm in order to prevent the user from touching the container body 2 with fingers and make the grip 4 easy to see.

Figure 7:
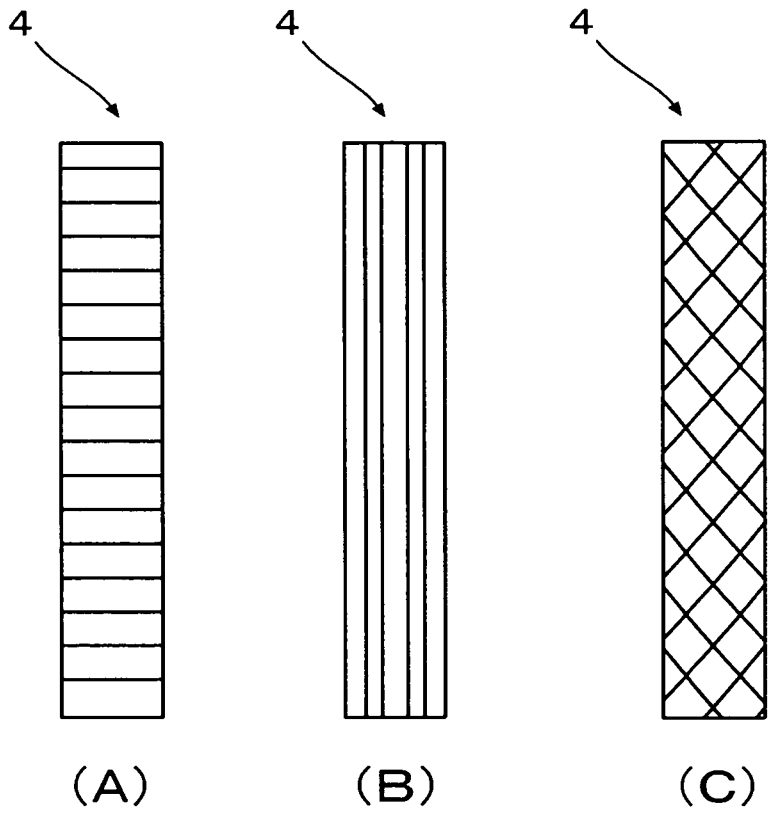
FIGS. 7A to 7C show examples of a processed surface of a grip of the dispensing containers shown in FIGS. 1 and 3.

The surface of the grip 4 preferably undergoes a non-slip treatment using circumferential lines shown in FIG. 7(A), a non-slip treatment using axial lines shown in FIG. 7(B), or a non-slip treatment using a diamond-shaped cutting pattern shown in FIG. 7(C) in order to allow the user to make fine adjustment of the pressure applied by the thumb, the index finger, and other fingers.

The grip 4 is preferably made of a thermosetting elastomer, a thermoplastic elastomer, or any other elastic material that shows low heat conductivity and provides user's fingers with satisfactory gripping sensation. Examples of the thermoplastic elastomer include a polyester-based thermoplastic elastomer, a styrene-based thermoplastic elastomer, a silicone rubber, and a fluororubber. The material of the grip 4 preferably contains a minimum amount of silica fillers and other additives that show high heat conductivity.

The cap 5 has a substantially triangular truncated conical shape or a rectangular columnar shape.

Including the examples shown in FIGS. 1 and 3, the length Lt of the dispensing container according to the invention except the cap 5 (hereinafter sometimes simply referred to as "the length Lt of the dispensing container 1") is designed in accordance with the amount of content but preferably ranges from 100 to 200 mm. When the length Lt of the dispensing container falls within the range described above, the user (dentist) can advantageously directly apply or dispense a dental liquid material on an application site as if the user grips a writing brush or a pen. It is noted that the length Lt of the dispensing container 1 is the sum of the length L of the grip 4 and the length Lc of the larger-diameter portion 22.

The ratio of the length Lt of the dispensing container 1 to the diameter D2 of the larger-diameter portion 22 of the container body 2 is defined as an aspect ratio. The aspect ratio Lt/D2 preferably ranges from 5 to 22. When the aspect ratio Lt/D2 falls within the range described above, the user can advantageously readily grip the dispensing container.

Figure 8:
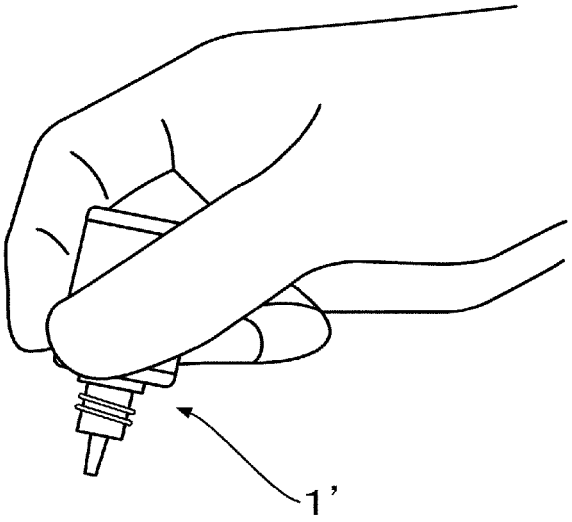
FIG. 8 PRIOR ART
FIG. 8 is a perspective view showing an example of how to use a dispensing container of related art.

In a dispensing container 1' of related art, the bottom surface of the dispensing container is exposed in some cases to allow the user, for example, to check the amount of liquid in the container, as shown in FIG. 8. In this case, heat is transferred through the portion of the container that comes into contact with the thumb, the index finger, the middle finger, and any other finger to the liquid, which expands in volume, and two or more droplets are disadvantageously dispensed.

The present inventor has conducted a study on the problem described above and found that heat radiation from the palm plays an important role as well as heat transfer. That is, the dispensing container 1' of related art has a relatively large diameter and a short length. To dispense a droplet, the user therefore often wraps the entire dispensing container with his/her hand with the bottom surface of the container facing the palm and uses the thumb, the index finger, the middle finger, and any other finger to pinch the side surface of the dispensing container. When the thumb, the index finger, the middle finger, and any other finger are used to pinch the side surface of the dispensing container, heat radiated from the palm directly reaches the bottom surface of the container. Further, since the distance between the palm and the bottom surface of the container is short, the amount of radiated heat is large.

Moreover, when a droplet is dispensed, that is, when the nozzle is oriented downward, vapor of the liquid and gases including air are present at the bottom of the container. The gases thermally expand due to the radiated heat. Specific heat of a gas is smaller than that of a liquid, and the coefficient of expansion of a gas is greater than that of a liquid. Expansion of a gas frequently causes a few droplets to be accidentally dispensed irrespective of the intention of the user. Further, heat transferred through the portion of the container that comes into contact with the thumb, the index finger, the middle finger, and any other finger expands the gas in the container, and the internal pressure in the container rises.

Figure 9:
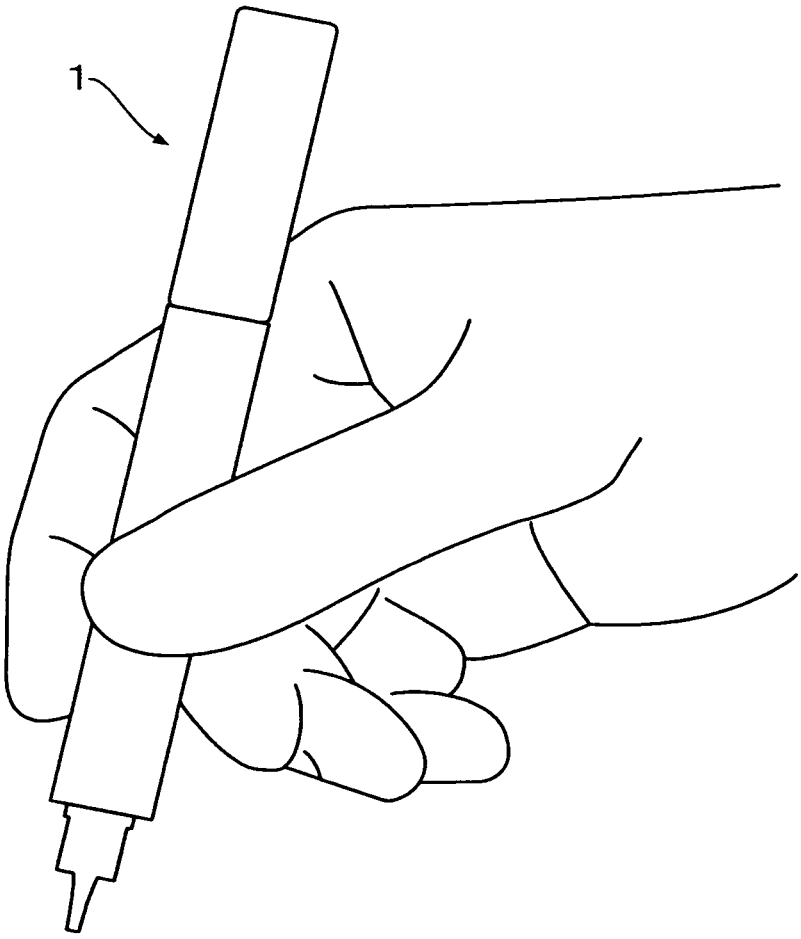
FIG. 9 is a perspective view showing an example of how to use the dispensing container according to the first embodiment of the invention.
Figure 10:
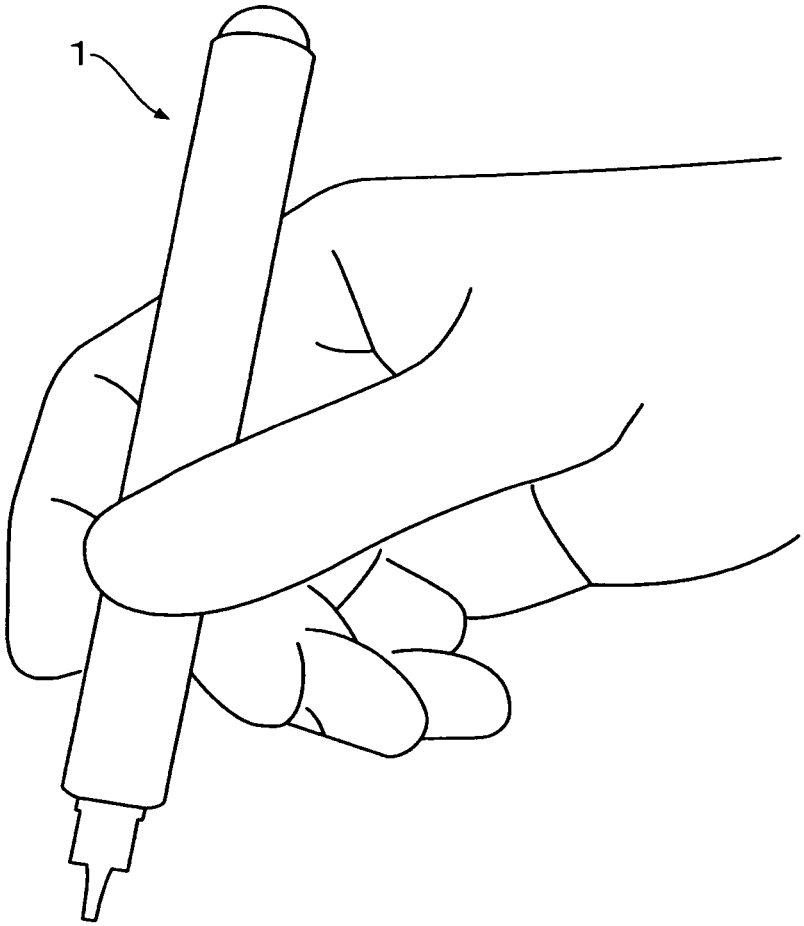
FIG. 10 is a perspective view showing an example of how to use the dispensing container according to the second embodiment of the invention.

Since the dispensing container according to the invention is so configured that the user holds the grip with the thumb, the index finger, and any other finger as shown in FIGS. 9 and 10, no finger will come into contact with the container, and the amount of heat radiated from the back of the hand to a gas present at the bottom of the container is very small, whereby a few droplets will not accidentally be dispensed.

According to the dispensing container 1 of the first embodiment, since the container body 2 has a rod-like shape as shown in FIG. 9, the dispensing container is compact, and the grip 4 having heat insulating capability can prevent heat originating from the temperature of a finger of the user from being transferred. The grip can further prevent heat radiation from a finger of the user to the larger-diameter portion 22, whereby radiated heat will not reach a gas accumulated in an upper end portion of the larger-diameter portion 22. As a result, change in the temperature of the content in the container body can be reduced. When the user uses the dispensing container, the user can hold and squeeze the grip 4 to dispense a single droplet, and no unintended excessive dispensing will occur.

Further, since the container body 2 is so formed that the diameter on one side is greater than that on the other side and the other side of the container body 2 is covered with the grip 4, the end of the grip 4 comes into contact with the end on the one side of the container body 2, whereby the grip 4 will not disengage from the container body 2 and the grip 4 will be easy to see.

Moreover, since the surface of the grip 4 has undergone a non-slip treatment, the user can make fine adjustment of the pressure applied by the thumb, the index finger, and any other finger, whereby the user can reliably extract and dispense a single droplet. Further, having a pen-like shape, the dispensing container 1 has not only a design similarity to a syringe for a composite resin having been widely used as a dental material but also a slimmer, newer shape than that of a container of related art.

The dispensing container according to the second embodiment provides the same advantageous effects provided by the dispensing container according to the first embodiment and includes a longer smaller-diameter portion 21 of the container body 2 as shown in FIG. 10, whereby the grip 4 having heat insulation capability can be longer. As a result, the ability to prevent heat transfer from a finger of the user to the smaller-diameter portion 21 and the ability to prevent heat radiation from a finger of the user to the larger-diameter portion 22 are further enhanced. In particular, heat radiated to the air accumulated in an upper end portion of the larger-diameter portion 22 can be further blocked, whereby the change in the temperature of the content in the container body can be further reduced. It is therefore possible to prevent unintended excessive dispensing more reliably.

The above embodiments have been described with reference to the case where the content in the dispensing container 1 is a drug solution, but the invention is applicable to any liquid having a low boiling temperature so that it is difficult to perform appropriate dispensing due to heat originating from the temperature of a finger of the user.

DESCRIPTION OF SYMBOLS

1, 1': dispensing container
2: container body
2*a*: discharge port
21: smaller-diameter portion
22: larger-diameter portion
3: nozzle
4: grip
5: cap

What is claimed is:

1. A dispensing container for dispensing a drug solution contained within the dispensing container, the dispensing container not structured to thread into another container, the dispensing container comprising:

a rod-shaped container body formed of a smaller-diameter portion having a discharge port that is an open end and a larger-diameter portion having a block end;

a nozzle that extends from the discharge port outward in an axial direction of the container body; and a grip made of a heat insulating material and covering an outer circumferential surface of the smaller-diameter portion of the container body;

wherein an edge of the grip is in contact with a stepped portion where the smaller-diameter portion and the larger-diameter portion are connected to each other;

wherein an outer diameter (D1) of the smaller-diameter portion of the container body ranges from 8 to 13 mm;

wherein the wall thickness of the smaller-diameter portion of the container body ranges from 0.3 to 0.9 mm;

wherein the grip is formed to have a wall thickness of at least 2 mm;

when the outer diameter (D1) and the wall thickness of the smaller-diameter portion of the container body fall within the range claimed above, the grip is formed to have the wall thickness claimed above, a user holds the grip like holding a pen, and the user applies pressure to the smaller-diameter portion through the grip with a thumb, an index finger, and any other finger, the smaller-diameter portion then deforms, whereby a single droplet of the drug solution is dispensed;

wherein a length (Lt) of the dispensing container is the sum of a length (L) of the grip and a length (Lc) of the larger-diameter portion;

wherein the length (Lt) of the dispensing container ranges from 100 to 200 mm;

wherein the length (L) of the grip is at least 50 mm;

wherein the length (Lc) of the larger-diameter portion ranges from 5 to 10 mm;

when the user holds the grip like holding the pen, and the user holds the grip with the thumb, the index finger, and any other finger, thereby no finger directly contacts the rod-shaped container body formed of the smaller-diameter portion, with the grip having a heat insulating capability which thereby prevents heat originating from a temperature of the fingers from being transferred to the rod-shaped container body formed of the smaller-diameter portion; and when the user holds the grip like holding the pen, and the user holds the grip with the thumb, the index finger, and any other finger, whereby an amount of heat radiated from the fingers and a back of the hand of the user to the larger-diameter portion is very small, and the radiated heat will not reach a gas accumulated in an upper end portion of the larger-diameter portion, as a result, a change in a temperature of the content in the dispensing container can be minimized, when the user uses the dispensing container, the user can hold and squeeze the grip to dispense a single droplet, and no unintended excessive dispensing of the drug solution will occur.

2. The dispensing container according to claim 1, wherein a ratio of a length (Lt) of a portion of the dispensing container except the nozzle to an outer diameter (D2) of the larger-diameter portion of the container body is defined as an aspect ratio, and the aspect ratio (Lt/D2) ranges from 5 to 22.

3. The dispensing container according to claim 1, wherein an outer diameter (D2) of the larger-diameter portion ranges from 9 to 18 mm.

4. The dispensing container according to claim 1, wherein the cross-sectional shape of the larger-diameter portion of the container body taken along a plane passing through a central axis of the container body is a rectangle, a semicircle, a semiellipse, a polygonal shape, or a curved shape.

5. The dispensing container according to claim 1, wherein at least part of the circumference of the smaller-diameter portion forms the stepped portion.

6. The dispensing container according to claim 1, wherein the cross-sectional shape of the larger-diameter portion taken along a plane perpendicular to the central axis of the container body is similar to that of the smaller-diameter portion.

7. The dispensing container according to claim 1, wherein the cross-sectional shape of the larger-diameter portion taken along a plane perpendicular to a central axis of the container body is not similar to that of the smaller-diameter portion.

8. The dispensing container according to claim 1, wherein the grip is made of an elastomer.

9. The dispensing container according to claim 1, wherein the surface of the grip undergoes a non-slip treatment.

* * * * *